United States Patent [19]

Hufnagl et al.

[11] 4,294,870

[45] Oct. 13, 1981

[54] METHODS AND DEVICE FOR CLADDING ELONGATED OBJECTS SUCH AS WIRES AND THE LIKE WITH POWDERED MATERIAL

[76] Inventors: Walter Hufnagl, Loininetstr. 9, 8 Munich, Fed. Rep. of Germany; Peter Kotaucaek, We. Sperlertz 58, 7030 Wien, Austria

[21] Appl. No.: 135,623

[22] Filed: Mar. 31, 1980

Related U.S. Application Data

[62] Division of Ser. No. 958,882, Nov. 8, 1978.

[30] Foreign Application Priority Data

Nov. 10, 1977 [DE] Fed. Rep. of Germany ..... 2750369

[51] Int. Cl.[3] ..... B05D 3/12

[52] U.S. Cl. ..... 427/189; 427/191; 427/194; 427/202; 427/203; 427/205; 427/278; 427/331; 427/357

[58] Field of Search ..... 29/420, 420.5; 428/553, 428/653; 75/208 R, 226, 249; 427/191, 194, 192, 357, 331, 278; 118/404, DIG. 18, 405; 425/79, 113

[56] References Cited

U.S. PATENT DOCUMENTS

| | | | |
|---|---|---|---|
| 2,287,826 | 6/1942 | Postlewaite et al. | 118/404 |
| 2,522,364 | 9/1950 | Grand | 118/404 |
| 3,088,195 | 5/1963 | Noethlich, Jr. et al. | 428/653 |
| 3,203,826 | 8/1965 | Stobierski | 427/357 |
| 3,389,010 | 6/1968 | Burch | 427/195 |
| 3,428,472 | 2/1969 | Shimose et al. | 427/191 |
| 3,669,738 | 6/1972 | Coffis et al. | 427/358 |
| 3,740,833 | 6/1973 | Hanson et al. | 427/191 |
| 3,962,990 | 6/1976 | Phipps et al. | 118/404 |
| 4,074,010 | 2/1978 | Knight | 427/192 |
| 4,102,678 | 7/1978 | Gothard et al. | 427/357 |

FOREIGN PATENT DOCUMENTS

| | | | |
|---|---|---|---|
| 529003 | 1/1977 | U.S.S.R. | 425/79 |

*Primary Examiner*—Stanley S. Silverman
*Attorney, Agent, or Firm*—Michael J. Striker

[57] ABSTRACT

A method of cladding a wire with a powdered metal includes feeding the wire in its axial direction, applying powdered metal around its surface, compacting the applied powdered layer on the surface and subsequently continuously rolling-over the applied layer on a helical path to provide a helical zone of metallurgically bonded powdered material. The device of this invention has a storage container for powdered material, a rotary shaft defining at its center a forwardly tapering passage with an internal thread acting as a worm conveyor, the shaft being terminated with an exchangeable outlet nozzle, the nozzle supporting a set of cladding rollers, the axes of rotation of which are inclined at an acute angle to the axis of the passage. The driving arrangement for the rollers is preferably driven by a separate motor.

3 Claims, 8 Drawing Figures

METHODS AND DEVICE FOR CLADDING ELONGATED OBJECTS SUCH AS WIRES AND THE LIKE WITH POWDERED MATERIAL

This is a division, of application Ser. No. 958,882, filed Nov. 8, 1978.

BACKGROUND OF THE INVENTION:

The present invention relates in general to a method of and a device for cladding elongated objects, such as wires and the like, with a material of different composition, preferably powdered metals resulting in a metallurgically bonded cladding.

From the prior art various methods are known for casting a thick metal layer around a metal strand. In one of these methods, the metal strand is heated in a preliminary heating zone to a temperature exceeding that which is necessary for inner bonding of the cast coating with the strand material but which is lower than the melting temperature of the cast layer. The metal strand in this known method is exposed to the casting metal in a bath through which it passes at a speed adjusted in accordance with the exposed length so as to produce a progressively increasing layer of the cast metal on the strand surface (German Pat. No. 1,521,195). This known over-casting method has the disadvantage that due to the passage of the strand through the molten metal the crystalline structure of the strand metal is changed and also other undesired phenomena will take place.

In another prior-art method the wire is first guided through an alignment apparatus, then through a cleaning device; thereafter it is guided through a bottom part of a funnel in which powdered metal to be applied thereon is stored and finally it passes through a set of rollers rotating in feeding direction of the wire. In this manner, however, the wire can be sprinkled only with a very thin layer of the powdered metal and as described, for example, in U.S. Pat. No. 3,088,195, this method is especially applicable for powdered aluminum. The rollers for impressing the powder layer into the wire act upon the latter in perpendicular direction and cause the powdered metal to bond to the wire surface. Thereupon an aftertreatment in a furnace and in an additional rolling device takes place, then a tempering in a tempering furnace and subsequently before winding of the cladded wire in a winding machine, the wire is subjected again to a rolling process in several sets of rollers, all of which act in perpendicular direction to the axis of the processed wire. The main disadvantage of this rather complicated cladding process is the perpendicular arrangement of cladding rollers by which the powdered metal is cladded almost exactly in axial direction of the strand. As a result, the finished product has axially extending zones of modified grain structures which considerably influence the strength of the wire and impart thereto metallurgically unfavorable properties which even after a complicated aftertreatment cannot be completely removed.

SUMMARY OF THE INVENTION

It is, therefore, a general object of this invention to overcome the aforementioned disadvantages of the prior art.

More particularly, it is an object of the invention to provide an improved method and device for cladding elongated objects such as cylindrical wires, pipes, rods or the like of metal or of a non-metallic material with a powdered metal or non-metallic material, which is not possessed of the above-described disadvantages.

In keeping with these objects, and others which will become apparent hereafter, one feature of the invention resides in a method in which a wire which may be pretreated or preliminarily sprinkled with the cladding powder, is first surrounded with a successively compacted layer of the cladding powder and together with the applied compacted layer is fed into a set of rollers, the axes of rotation of which form an acute angle with the axis of the wire and which rollers are simultaneously rotated relative to the axis so that the layer of metal powder is metallurgically bonded to the surface of the wire in a spiral-like manner. Subsequently, the wire with the cladding can be subjected to an aftertreatment such as a chemical, mechanical or thermal treatment or a combination thereof.

Another feature of this invention also resides in the provision of a device which includes a storage container for the cladding powder, the container communicating with an internally threaded rotary hollow shaft acting as a worm conveyor through which the wire is guided and discharged through a nozzle at the outlet opening of the shaft, the nozzle supporting at least one set of cladding rollers, the axes of rotation of which are directed at an acute angle relative to the axis of the wire, and the whole set being supported for rotation about this axis.

The method of this invention and the device for carrying out this method results in a spiral-like cladding zone composed of individual spirals bonded to the wire and overlapping at least partially at their marginal areas. The method of this invention insures that the finished product is without axially extending zones of modified granular structure with the accompanying unremovable disadvantages. By virtue of the spiral-like or thread-like configuration of the cladding of powdered material, an improved strength of the wire in comparison with prior-art axial patterns of the cladding will result. As a consequence, the clad wires produced in accordance with this invention is devoid of the metallurgically unfavorable properties and is improved in strength. The method of this invention further makes it possible to modify the pattern of the cladding by adjusting the distance between the overlapping sides of individual spirals produced by the cladding rollers. In this manner, the marginal parts in each spiral of bonded layer can overlap and diffuse into one another or it is also possible to leave a minute spacing between the individual spirals of rolled-over layer portions. Thereafter, the wire can be aftertreated not only in its inner grain structure, but also superficially by smoothing, roughening or knurling.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 1:
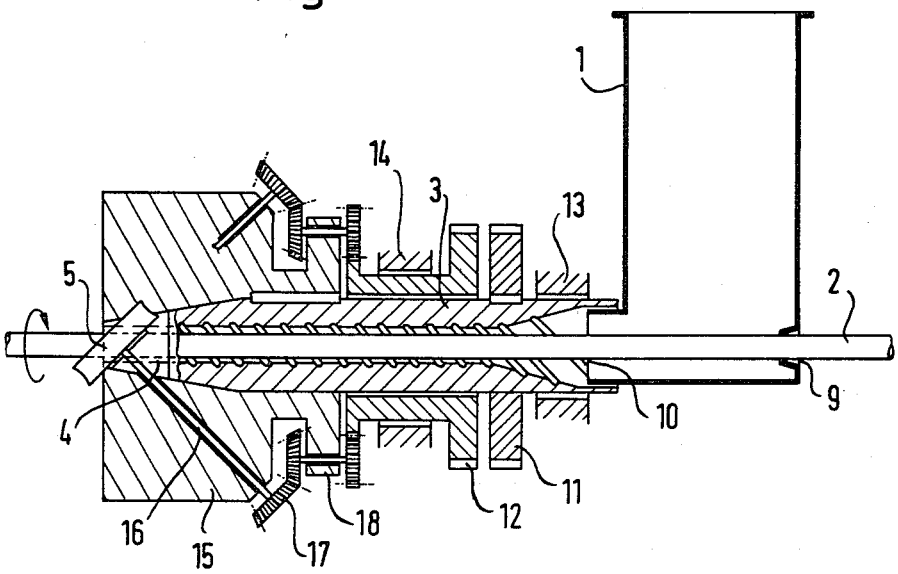
FIG. 1 is a schematic sectional side view of the device of this invention.

DESCRIPTION OF THE PREFERRED EMBODIMENTS:

Referring firstly to FIGS. 1–4, storage container 1 for cladding material such as powdered metal has an inlet opening 9 and a juxtaposed outlet opening 10. Wire 2 to be clad is guided by conventional means (not shown) to pass through the openings 9 and 10 and to enter an internally threaded hollow shaft 3 defining a tapering passage which communicates at its flared inlet portion with the outlet opening 10 of container 1 and at its tapered outlet portion with a nozzle 4. Nozzle 4 supports a set of three rollers 5 supported for rotation about axles 16 which form an acute angle with respect to the axis of hollow shaft 3 corresponding to the feeding direction of wire 2. The advance of wire 2 can be effected as mentioned above by non-illustrated conventional means such as a drawing device, driving rollers and the like, but the wire 2 can also be advanced by means of cladding rollers 5. In this case rotary head 15 which supports axles 16 for rollers 5 is coaxial with the feeding direction so that the wire is guided along a straight line ("floats") or the rollers and the rotary head can be arranged in such a manner so as to apply twist to the wire.

In the example as shown in FIG. 1, wire 2 is preliminarily sprinkled with the cladding powder during its passage through container 1. It is, of course, also possible to apply the cladding powder immediately upon the entry of wire 2 into the flared inlet portion of the internally-threaded passage of hollow shaft 3. The shaft is supported for rotation in bearing 13 and in a rotary sleeve 12′ which supports driving gear 12 and is itself supported for rotation in bearing 14. During the rotary movement of the internally-threaded shaft 3 which acts as an internal worm conveyor, cladding powder from container 1 is first applied around wire 2 in the flared or funnel-like inlet portion of the tapering central passage so that a relatively loose layer is initially formed in the conveyor. This loose layer is progressively compacted in the tapering portion of the central passage and discharged through nozzle 4 to be bonded by the pressure exerted by rollers 5 in oblique direction relative to the axis of the wire. Due to the forward movement of wire 2 and to the oblique position of the rotating set of cladding rollers 5, the resulting bonded portions of the compacted and impressed powdered layer have a spiral-like form and overlap each other.

Preferably the speed of advance of the powdered material conveyed by the internal worm conveyor in shaft 3 is equal to the feeding speed of wire 2. If desired, however, it is also possible to delay or to increase the feeding speed of wire 2 relative to the feeding speed of the powdered layer.

The outlet end of the tapering central passage is provided with an exchangeable nozzle 4; the inner diameter of the passage slightly exceeds the diameter of the wire, for example, the clearance of the passage is about 1/10 to 5/10 millimeters larger than the wire diameter. The number of internal threads of shaft 3 corresponds preferably to the number of cladding rollers 5. If, for example, a set of three cladding rollers 5 is employed, then the internal worm conveyor in shaft 3 is provided with three internal threads. The pitch and the size of the respective threads is geometrically adjusted to the arrangement and inclination of cladding rollers 5 so that the center line of each roller coincides with the center line of corresponding threads in shaft 3.

It is advantageous, but not necessary, to arrange cladding rollers 5 within the range of outlet nozzle 4. For this purpose nozzle 4 is provided with recesses 6 adapted for accommodating the rollers 5 and is also provided with through holes for axles 16, as illustrated in detail in FIGS. 3 and 4.

In the example shown, rotary head 15 has a tapering central boring connected to the rotary shaft 3 and supports for rotation in bearings 18 bevel gears 17 which drive via axles 16 cladding rollers 5. Bevel gears 18 are driven by driving gears 12″ supported on rotary sleeve 12′, the driving gears being in mesh with transmission gears 12 driven by a driving motor (not shown).

As has been mentioned above, shaft 3 with internal worm conveyor is supported for rotation in rotary sleeve 12′ and is driven together with head 15 independently of driving gears 12 by driving gear 11.

The separation of driving gears 12 and 11 makes different variations of rotary movements of internal worm conveyor and of cladding rollers 5 possible. For example, cladding rollers 5 can be driven independently of the movement of rotary head 15 or together with the rotary head but at a different transmission ratio. The rotation of rotary head 15 relative to the rotation (number of revolutions) of cladding rollers can be adjusted, such that no torsional moment is imparted to the advancing wire 2. This adjustment, in a further modification of this invention, can be accomplished by a separate drive for rotary head 15, for example by means of an auxiliary motor driving the head with cladding rollers independently of shaft 3. The torsional moment of this auxiliary motor is to be at least equal to the sum of all frictional and inertial losses of the system.

Figure 2:
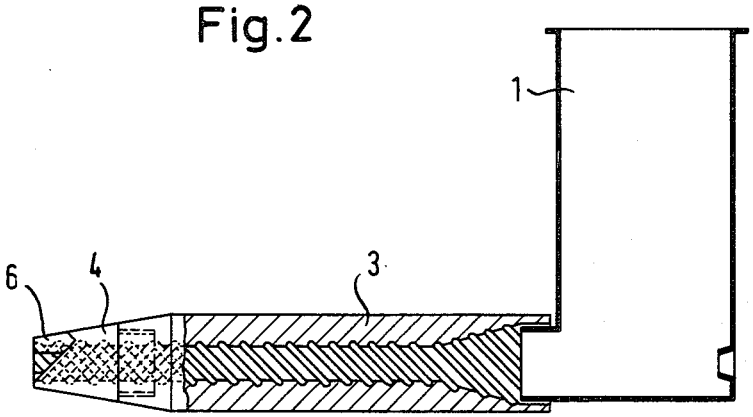
FIG. 2 shows in a sectional side view the rotary hollow shaft with internally threaded conveyor forming a part of the device of FIG. 1.

FIG. 2 shows in a partly sectional view rotary hollow shaft 3 defining a tapering passage terminated with nozzle 4, the passage having internal threads acting as an internal worm conveyor. The outlet opening of storage container 1 for powdered metal has an outwardly projecting collar communicating with the funnel-shaped inlet portion of the worm conveyor. Nozzle 4 is provided with oblique recesses 6 for accommodating cladding rollers 5.

Figure 3:
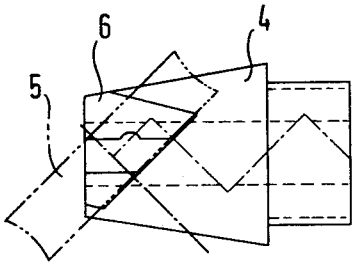
FIG. 3 is a side view of an outlet nozzle in the device of FIG. 1.
Figure 4:
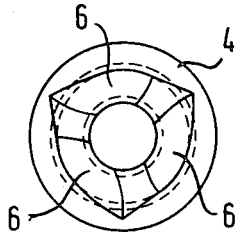
FIG. 4 is a front view of the nozzle of FIG. 3.

FIGS. 3 and 4 show in more detail outlet nozzle 4 with three uniformly distributed recesses 6 arranged at an acute angle with respect to the axis of nozzle 4. Cladding rollers 5 have their axes of rotation perpendicular to these oblique surfaces. As a result, rollers 5 exert pressure in an oblique direction against circumferential portions of the advancing wire and produce a helical shape of the bonded cladding.

Figure 5:
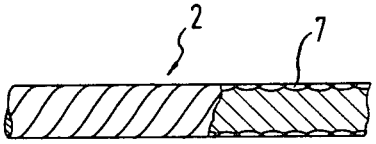
FIGS. 5–8 illustrate different elongated objects clad by the method of this invention.
Figure 6:
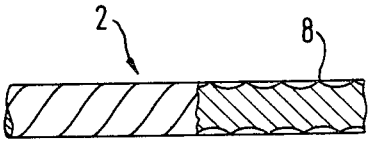

FIG. 5 shows wire 2 clad in accordance with the method of this invention. The mutual arrangement of cladding rollers 5 can be selected such that the resulting helical zones 7 of powdered cladding metal overlap each other or alternatively, rollers 5 are staggered such that the zones 7 are a small distance apart from each other and a less compact cladding is produced between the zones. As illustrated in FIG. 6, helical zones 8 resulting from the compressing force of three cladding rollers 5 overlap each other so that complete overlapping and uniform cladding will result.

Figure 7:
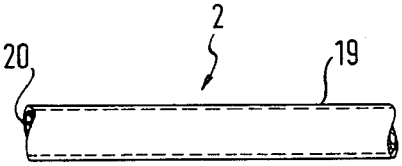

FIG. 7 shows cladding 19 after it has been finished into a smooth upper surface. The smoothing process is effected by smooth rollers 5 and is suitable particularly for wires 2 or rods 20 of larger diameter. Prior to the application of the smooth cladding 19 rods 20 can be subjected to a preliminary treatment of their upper surface, such as smoothing or roughening or may even be provided with recesses. The final product, however, has a smooth-surfaces cladding.

Figure 8:
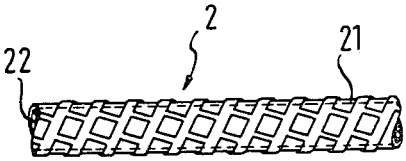

Another example of the final products manufactured in the device of this invention is shown in FIG. 8. Wire 2 or rod 22 can also be pretreated to have a roughened upper surface and according to the pattern of rollers 5 the cladding 21 on the surface of the wire can be made in the form of helical zones 21 regularly bridged by transverse ribs. These ribs can be made only in the overcoat and the bonding of powdered metal is effected with a sublayer which had been applied between material of rod 22 and the overcoating. In a variation, the recesses can penetrate through the underlying layer and be bonded to material of rod 22 whereby the overcoating material is impressed into the rod material. It will be noted that it is possible to combine the cladding patterns as shown in FIGS. 5–8 and further modify these combinations.

The methods and device of this invention are also suitable for powder metallurgy. For example it is possible to apply a layer of sintered powdered metal on round rods or to apply ceramic coatings on high-temperature resistant rods or to clad an abrasion resistant material onto soft and toughened rod material.

It will be understood that each of the elements described above, or two or more together, may also find a useful application in other types of constructions differing from the types described above.

While the invention has been illustrated and described as embodied in a method of and a machine for cladding elongated objects such as wires and rods with powdered material, it is not intended to be limited to the details shown since various modifications and structural changes may be made without departing in any way from the spirit of the present invention.

What is claimed as new and desired to be protected by Letters Patent is set forth in the appended claims.

1. A method of cladding elongated objects such as wires and the like with a powdered material, comprising the steps of sprinkling the object to be clad with the powdered material by passing the object through a storage container; continuously feeding the object in its axial direction through a rotary internal worm conveyor having an outlet provided with a nozzle for continuously applying a layer of powdered material onto the surface of the advancing object during the feeding operation; and roll pressing said applied layer to the surface of the object in its path through a set of pressing rollers, the roll pressing being applied to said layer in a direction forming with said axial direction an acute angle to thereby obtain said elongated object the compacted powdered layer with bonded portions having spiral-like form and overlapping each other.

2. A method as defined in claim 1, wherein prior to its cladding said elongated object is provided with a coating of different material.

3. A method as defined in claim 1, further comprising the step of aftertreating the clad object by a chemical, mechanical and thermal process.

* * * * *